United States Patent [19]

Nishimori et al.

[11] Patent Number: 4,743,946

[45] Date of Patent: May 10, 1988

[54] COPYING MACHINE DESIGNED TO SUCCESSIVELY COPY TWO DIFFERENT DOCUMENTS ON DIFFERENT RECORDING MEDIUM SURFACES

[75] Inventors: Kadotaro Nishimori; Yutaka Irie, both of Toyokawa, Japan

[73] Assignee: Minolta Camera Kabushiki Kaisha, Osaka, Japan

[21] Appl. No.: 914,078

[22] Filed: Oct. 1, 1986

[30] Foreign Application Priority Data

Oct. 22, 1985 [JP] Japan ..... 60-234513

[51] Int. Cl.[4] ..... G03G 15/00; G03G 27/32

[52] U.S. Cl. ..... 355/14 C; 355/14 E; 355/25

[58] Field of Search ..... 355/14 R, 14 E, 14 C, 355/7, 25

[56] References Cited

U.S. PATENT DOCUMENTS

| | | | |
|---|---|---|---|
| 4,017,173 | 4/1977 | Komori et al. | 355/8 |
| 4,394,087 | 7/1983 | Irie et al. | 355/14 E |
| 4,451,137 | 5/1984 | Farley | 355/14 R |
| 4,607,946 | 8/1986 | Uchiyama et al. | 355/14 R |

FOREIGN PATENT DOCUMENTS

| | | | |
|---|---|---|---|
| 30553 | 2/1984 | Japan | 355/14 C |
| 170868 | 9/1985 | Japan | 355/14 C |

*Primary Examiner*—R. L. Moses
*Assistant Examiner*—Ed Pipala
*Attorney, Agent, or Firm*—Burns, Doane, Swecker & Mathis

[57] ABSTRACT

A copying machine capable of operating in the divisional copying mode in which first and second documents, such as the successive pages of an open book, placed on the contact glass are copied on different recording medium surfaces, respectively. The copying machine is provided with copying condition setting means capable of individually setting different copying conditions, such as copied image density, for the first and second documents, respectively. The first document and the second document are scanned under the copying condition set for the first document and under the copying condition set for the second document, respectively, and the first and second documents are copied on different recording medium surfaces, respectively.

18 Claims, 4 Drawing Sheets

COPYING MACHINE DESIGNED TO SUCCESSIVELY COPY TWO DIFFERENT DOCUMENTS ON DIFFERENT RECORDING MEDIUM SURFACES

BACKGROUND OF THE INVENTION

1. Field of the Invention:

The present invention relates to a copying machine and, more specifically, to a copying machine incorporating a copying system capable of successively copying two different documents, such as the successive pages of an open book, on two different recording medium surfaces.

2. Description of the Prior Art

Recently, an electrophotographic copying machine, such as disclosed in U.S. Pat. No. 4,017,173, incorporating a copying system capable of successively copying two different documents on two different recording medium surfaces has been proposed to improve the efficiency of copying operation. In such a copying machine, the successive pages of an open book placed on the contact glass are scanned successively and are copied on the respective surfaces of two separate copying sheets or on the opposite sides of a single copying sheet in a single copying cycle. Accordingly, copying sheets need not be cut in a predetermined size, and hence such a copying machine is capable of efficient copying operation.

However, the conventional copying machine incorporating such a copying system is merely capable of successively copying different documents in the same copying conditions.

As regards copied image density, one of the copying conditions, for example, in copying the successive pages of an open book placed on the contact glass in a single copying cycle, the copying machine is unable to be set in two different copying conditions appropriate to the different pages, respectively. Therefore, when the two pages are different from each other in original image density, one or both of the pages are not copied in a desired copied image density. Such a problem arises also in successively copying two different documents different from each other in original image density in a single copying cycle.

As regards copying magnification, another copying condition, in successively copying two documents different from each other in size in a single copying cycle, the sizes of the respective copied images of the two documents are different from each other, because the conventional copying machine is unable to be set in different copying magnifications for the two documents, and hence it is impossible to obtain the copies of the same image size from documents different from each other in size.

SUMMARY OF THE INVENTION

Accordingly, it is an object of the present invention to provide a copying machine incorporating such a copying system capable of being set in different copying conditions appropriate to two different documents placed on the contact glass, respectively.

It is another object of the invention to provide a copying machine incorporating such a copying system capable of successively copying two different documents setting the copied image density individually.

The above and other objects, features and advantages of the present invention will become more apparent from the following description taken in conjunction with the accompanying drawings.

DETAILED DESCRIPTION OF THE PREFERRED EMBODIMENT

Figure 1:
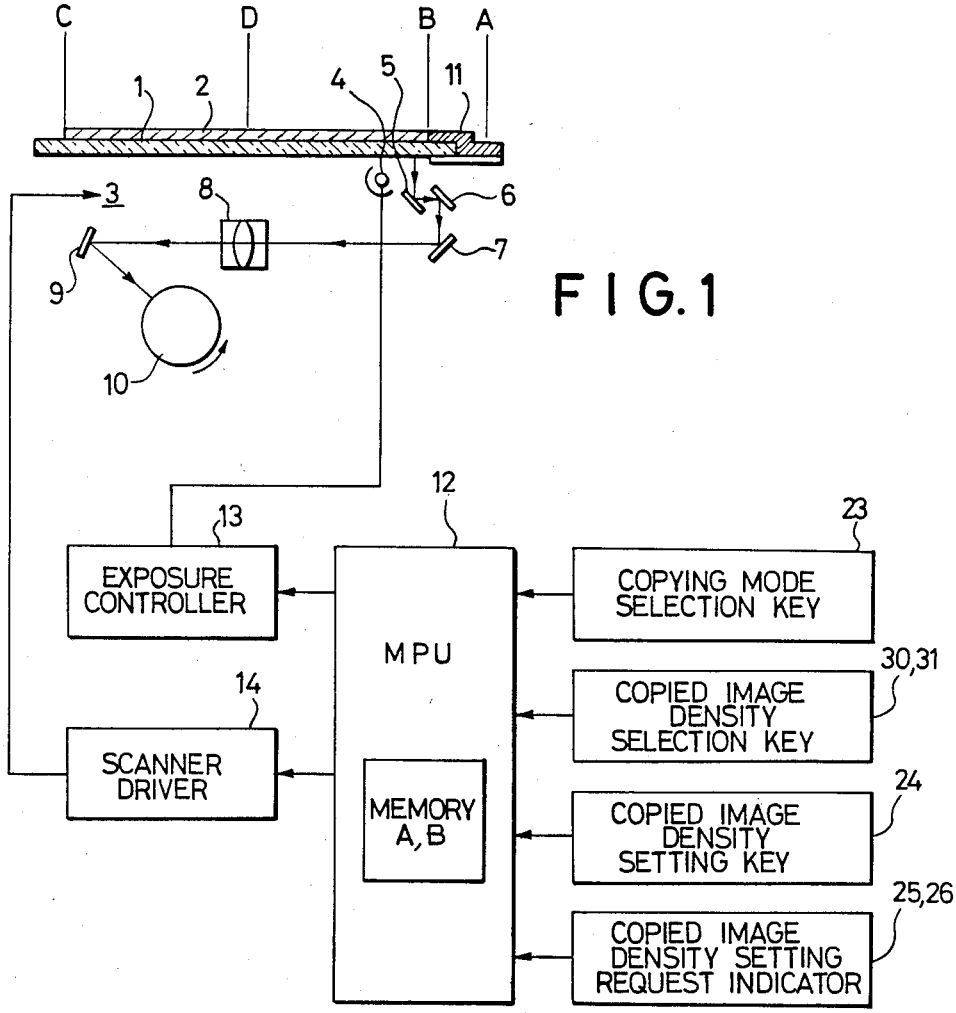
FIG. 1 is a diagrammatic illustration showing the constitution of an electronic copying machine equipped with a copying condition setting device, capable of a divisional copying mode.

The constitution of a copying machine incorporating the present invention will be described hereinafter with reference to FIG. 1.

The copying machine is capable of being set in two copying modes, namely, a first copying mode in which the entire copying area of the contact glass is scanned continuously to copy the image of a document placed on the contact glass on a single copying surface, and a second copying mode in which the copying area is divided across the scanning direction into a first copying area and a second copying area, and different documents placed in the first and second copying areas, respectively, are scanned individually to copy the doucments on different copying surfaces, respectively. The second copying mode will be referred to as "the divisional copying mode" hereinafter.

A contact glass 1 formed of a glass plate is mounted with a document 2 to be copied. A scanning optical system (hereinafter referred to as "scanner") 3 is disposed below the contact glass 1. The scanner 3 comprises an exposure lamp 4 for illuminating the document 2, reflecting mirrors 5, 6 and 7, a projecting lens 8, a reflecting mirror 9, and a mechanism, not shown, for synchronously operating those components.

In copying operation, the exposure lamp 4 and the first reflecting mirror 5 travel leftward, as viewed in FIG. 1, to scan the document 2, while the second reflecting mirror 6 and the third reflecting mirror 7 travel leftward, as viewed in FIG. 1, at half the speed of the first reflecting mirror 5 so that the length of focusing light pass is always constant. A photosensitive drum 10 is rotated counterclockwise as indicated by an arrow in FIG. 1 in synchronism with the leftward travel of those movable components of the scanner 3. Consequently, an electrostatic latent image of the document 2 is formed over the circumference of the photosensitive drum 10. The electrostatic latent image is developed, is transferred to a copying sheet, and then is fixed by well-known means.

Indicated at 12 is a microprocessor for controlling the copying machine, which includes memories A and B storing predetermined values of copied image density. Indicated at 13 is an exposure controller which controls the luminous intensity of the exposure lamp 4 by supplying an electric power corresponding to the set values of copied image density stored in the memories so that the copied image density coincides with a desired copied image density, and indicated at 14 is a scanner driver.

Indicated at 23 is a divisional copying mode selection key which, when operated, gives a divisional copying mode selection signal to the microprocessor 12. Indicated at 30 and 31 are copied image density selection keys for selecting a copied image density suitable for the document. A copied image density setting key 24 is operated to store a selected copied image density in the memories A and B of the microprocessor 12. Indicated at 25 and 26 are copied image density setting request indicator.

Copying operation in the divisional copying mode will be described hereinafter with reference to FIGS. 1 and 2.

Figure 2:
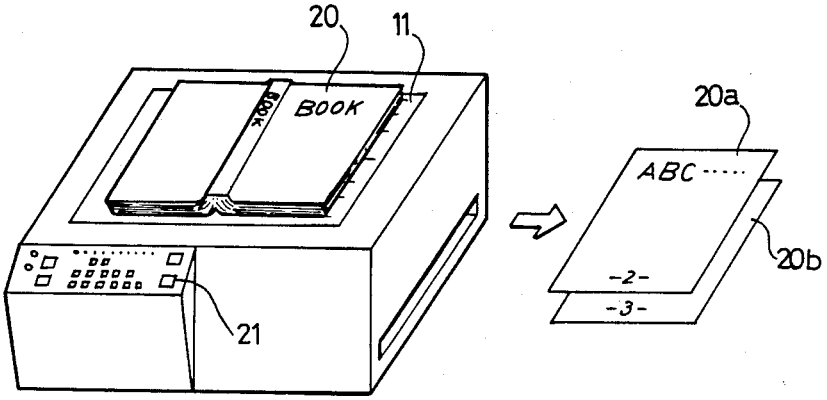
FIG. 2 is a perspective view of a copying machine of assistance in explaining the copying operation in the divisional copying mode for copying the two successive pages of an open book.

Referring to FIG. 2, a book 20 opened at a desired page is placed on the contact glass 1 with the right-hand edge thereof in contact with a document scale 11, and then a print key 21 is operated once to produce the respective copies 20*a* and 20*b* of the successive pages of the open book 20. In setting the copying machine in the divisional copying mode, the copied image density setting request indicator LED's 25 and 26 light up when the divisional copying mode selection key 23 is operated to select the divisional copying mode. Copied image densities appropriate to the pages of the open book, respectively, are decided by operating the copied image density selection keys 30 and 31, and then the copied image density setting key 24 is operated to store the desired copied image densities in the memories of the microprocessor 12. Then, the microprocessor 12 actuates a scanner driver 14 to scan the documents individually. During the scanning operation, the exposure controller 13 controls the luminous intensity of the exposure lamp 4 by regulating the power to be applied to the exposure lamp 4 according to the set copied image densities stored in the memories thereof so that the images are copied in desired image densities, respectively.

The manner of operation of the copying machine in the divisional copying mode will be described with reference to FIGS. 3(*a*) and 3(*b*).

Figure 3:
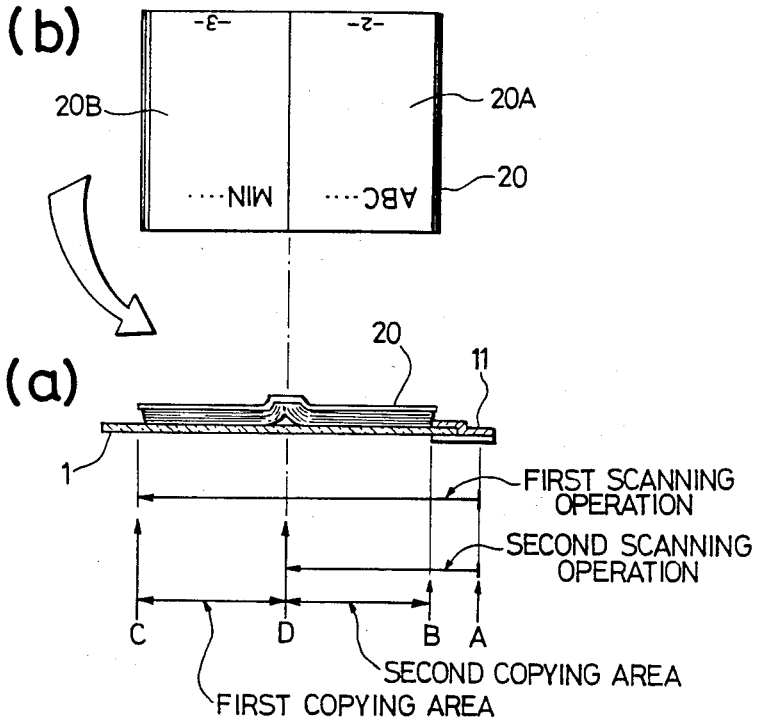
FIGS. 3(*a*) and 3(*b*) are illustrations of an assistance in explaining the manner of copying operation.

As illustrated in FIG. 3(*a*), first, a page 20B (hereinafter referred to as "document surface B") having a higher page number than the other page 20A (hereinafter referred to as document surface A") as shown in FIG. 3(*b*) is subjected to a first copying operation, in which the first copying area is scanned by the scanner 3 from a point D to a point C as illustrated in FIG. 3(*a*) to produce a copy 20*b* of the document surface B as shown in FIG. 2. Then, the movable components are returned to a position corresponding to a point A, and then the page 20A, namely, the document surface A, is subjected to a second scanning operation, in which the second copying area is scanned by the scanner 3 from a point B to the point D to produce a copy 20*a* of the document surface A. Thus the copies are delivered in the reverse order of page, and thereby the copies are piled up with a copy having a smaller page number above a copy having a larger page number.

Figure 4:
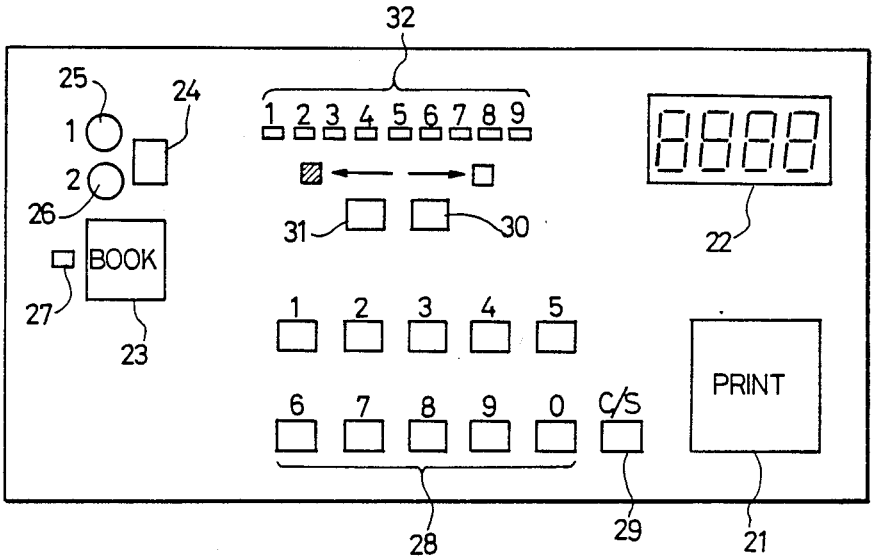
FIG. 4 is a plan view of a control panel, in a preferred embodiment, according to the present invention.

The arrangement of the control panel of the copying machine will be described hereinafter with reference to FIG. 4.

The control panel is provided with the print key 21, an indicator 22 for indicating the number of copies, the divisional copying mode selection key 23, the copied image density setting key 24, the copied image density setting request indicator LED 25 for indicating request for setting a copied image density for a document placed in the second copying area for divisional copying operation, the copied image density setting request indicator LED 26 for indicating request for setting a copied image density for a document placed in the first copying area for divisional copying operation, a ten-key numeric keyboard 28 for setting the number of copies to be produced, a clear/stop key 29 capable of clearing the set number of copies to reduce the set number to one and stopping the copying operation while a plurality of the same copies are being produced, a copied image density selection key 30 for setting a copied image density higher than the present copied image density, a copied image density selection key 31 for setting a copied image density lower than the present copied image density, and a copied image density level indicating LED's 32 for indicating the level of the set copied image density among nine levels of copied image densities.

The manipulation of the control panel and the corresponding operation of the copying machine will be described hereinafter.

Figure 5:
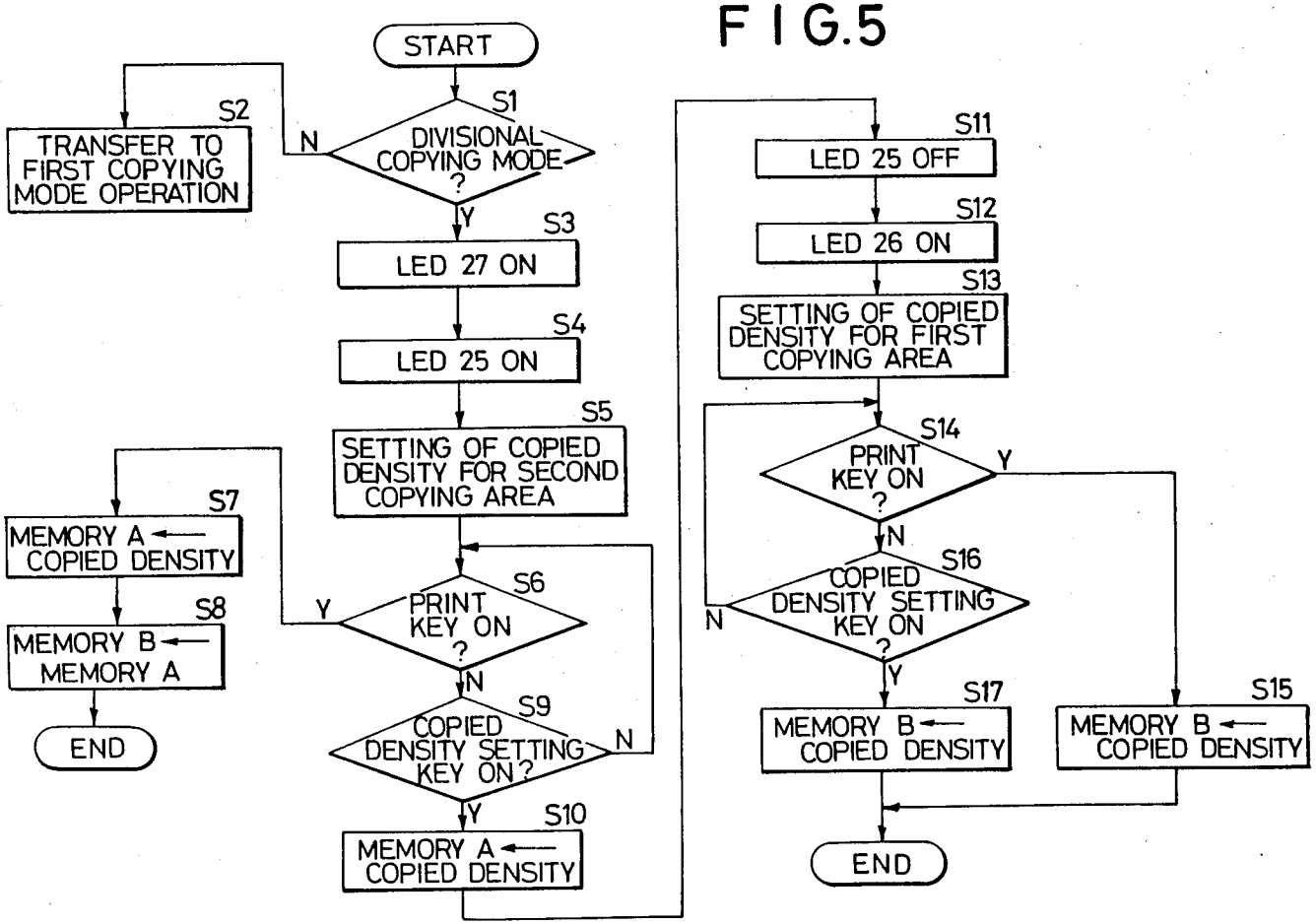
FIG. 5 is a flow chart showing the procedure for setting the copying machine in the divisional copying mode.

Ordinarily, the copying machine is set in the first copying mode, in which the entire copying area of the contact glass 1 is scanned continuously to copy a document placed on the contact glass 1 on a single copying surface. When the divisional copying mode selection key 23 is depressed, the copying machine is set in the divisional copying mode. When the divisional copying mode selection key 23 is not depressed, the LED 27 for indicating the setting of the copying machine in the divisional copying mode and the LED's 25 and 26 for indicating request for setting copied image densities for documents placed in the second and first copying areas, respectively, for divisional copying operation do not light up, and any data of copied image density is not stored in the memory if the copied image density setting key 24 is depressed. When the divisional copying mode selection key 23 is depressed to select the divisional copying mode, a routine represented by the flow chart of FIG. 5 is executed. It is to be noted that the flow chart of FIG. 5 shows the succession of operations, not the program for the microprocessor for controlling the copying machine.

The succession of operation of the copying machine will be described with reference to FIG. 5.

A decision is made at step S1 as to whether or not the divisional copying mode selection key 23 is depressed. When the decision is NO, the routine goes to step S2, where copying operation in the first copying mode is carried out. When the decision at step S1 is YES, the routine advances to steps S3 and S4, where the LED 27 for indicating the selection of the divisional copying mode and the LED for indicating request for setting a copied image density for the second copying area, namely, for the document surface A, in the contact glass 1 are lighted up. Then, at step S5, the copied image density setting key 30 or 31 is operated to set a desired copied image density for the second copying area. At step S6, a decision is made as to whether or not the print key 21 is depressed. When the decision at step S6 is YES, the routine advances to steps S7 and S8, where the set copied image density is stored in the memory A and stores the contents of the memory A in the memory B. When the decision at step S6 is NO, the routine goes to step S9, where a decision is made as to whether or not the copied image density setting key 24 is depressed. When the decision at step S9 is YES, the routine goes to step S10, where the set copied image density is stored in the memory A. Then, at step S11, the LED 25 indicating request for setting a copied image density for the second copying area is turned off, and then, at step S12, the LED 26 for indicating request for setting a copied image density for the first copying area is lighted up. At step S13, similarly to the operation at step S5, a copied image density for the first copying area is set by operating the copied image density selection key 30 or 31. At step S14, a decision is made as to whether or not the print key 21 is depressed. When the decision at step S14 is YES, the routine goes to step S15, where the set copied image density is stored in the memory B. When the decision at step S14 is NO, a decision is made at step S16 as to whether or not the copied image density setting key 24 is depressed. When the decision at step S16 is NO, the routine returns to step S14, where a decision is made again as to whether or not the print key 21 is depressed. When the decision at step S16 is YES, the routine goes to step S17, where the set copied image density is stored in the memory B.

Thus, when the divisional copying mode is selected, desired copied image densities for the first and second copying areas, respectively, are set through the foregoing procedure. When the print key 21 is depressed after the copied image densities have been thus set, the exposure controller 13 controls the luminous intensity of the exposure lamp 4 by regulating the power to be applied to the exposure lamp 4 according to the set copied image density stored in the memory B in the first scanning operation for scanning the first copying area in the contact glass 1, and according to the set copied image density stored in the memory A in the second scanning operation for scanning the second copying area in the contact glass 1 so that the documents are copied in the desired copied image densities, respectively. Thus, in copying the document surface A and the document surface B of the book placed on the contact glass 1 as illustrated in FIG. 2, the respective copies of the document surface A and the document surface B are printed in the desired copied image densities, respectively.

The copied image density level indicating LED's 32 indicate the level of the copied image density for the first copying area in scanning the first copying area and indicate the level of the copied image density for the second copying area in scanning the second copying area. It is also possible to simultaneously indicate the levels of the copied image densities for both the first and second copying areas by employing copied image density indicating LED's each capable of glowing in two different colors.

Figure 6:
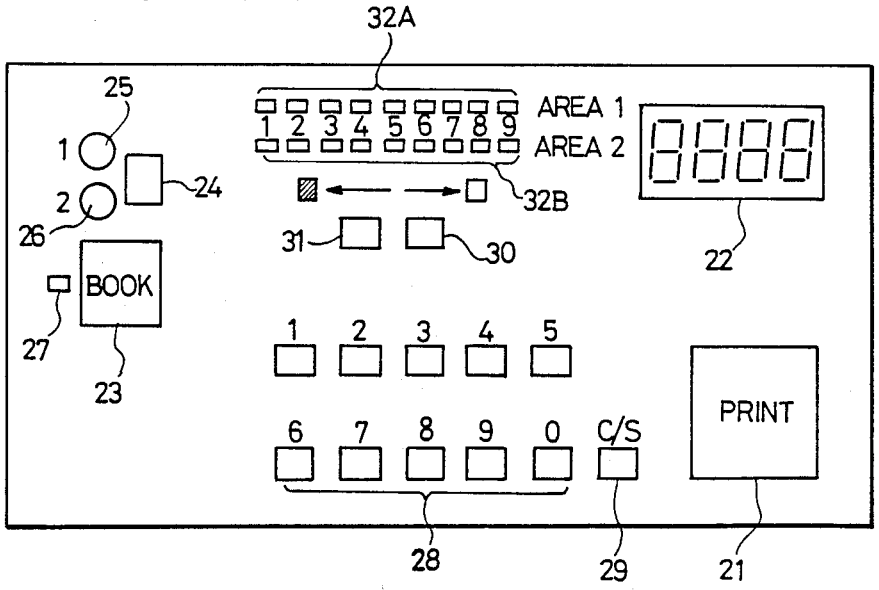
FIG. 6 is a plan view of a control panel, in another embodiment, according to the present invention.

FIG. 6 illustrates a control panel, in another embodiment, according to the present invention. This control panel is provided with a set of copied image density level indicating LED's 32A for indicating the copied image density level for the first copying area, and a set of copied image density level indicating LED's 32B for indicating the copied image density level for the second copying area, to indicate the respective copied image density levels individually.

Although the invention has been described as applied to a copying machine capable of setting copied image densities for divisional copying areas, respectively, it is also possible to apply the present invention to a copying machine in which other copying condition, such as magnification, are set selectively for separate divisional copying areas.

Furthermore, in the embodiments described herein, the luminous intensity of the exposure lamp is controlled according to the set copied image density to print the copy in a desired copied image density, it is also possible to print the copy in a desired copied image density by controlling the developing bias.

It is further understood by those skilled in the art that the foregoing description is preferred embodiments of the disclosed device and that various changes and modifications may be made in the invention without departing from the spirit and scope thereof.

We claim:

1. A copying apparatus comprising:

means for mounting thereon an original document to be copied;

process means for copying a first portion of said original document on a first recording medium surface and a second portion of said original document on a second recording medium surface;

input means for inputting first data relating to copying condition for copying the first portion of the original document and for inputting second data relating to copying condition for copying the second portion of the original document;

first entry means for storing said first data in a second memory means;

second entry means for storing said second data in a second memory means;

control means for controlling said process means to effect copying of the first portion of the original document based on said first data and to effect copying of the second portion of the original document based on said second data; and third entry means for storing said first data in said first memory means and for storing said first data in said second memory means as said second data.

2. A copying apparatus according to claim 1, wherein said first and second data are related to densitites of images to be formed on the recording mediums.

3. A copying apparatus according to claim 2, wherein said process means includes lamp means for illuminating the original document, and said control means controls the quantity of light emitted by said lamp means by controlling the power supplied to said lamp.

4. A copying apparatus comprising:

means for mounting thereon an original document to be copied;

process means for copying a first portion of said original document on a first recording medium surface and a second portion of said original document on a second recording medium surface;

input means for inputting the first data relating to the density of the image to be formed for copying the first portion of the original document and for inputting the second data relating to the density of the image to be formed for copying the second portion of the original document;

first entry means for storing said first data in a first memory means;

second entry means for storing said second data in a second memory means;

control means for controlling said process means to effect copying of the first portion of the original document based on said first data and to effect copying of the second portion of the original document based on said second data; and third entry means for storing said first data in said first memory means and for storing said first data in said second memory means as said second data.

5. A copying apparatus according to claim 4, wherein said process means includes lamp means for illuminating the original document, and said control means controls the quantity of light emitted by said lamp means by controlling power supplied to said lamp.

6. A copying apparatus comprising:

means for mounting thereon an original document to be copied;

process means for copying substantially all area of the original document on a single surface of a recording medium in a first copying mode and for copying a first portion of said original document on a first recording medium surface and a second portion of said original document on a second recording medium surface in a second copying mode;

selection means for selecting one of said modes;

input means for inputting data relating to the density of the image to be formed on the recording medium to a desired value;

first memory means for storing the data which are related to the image density for copying said first portion of the original document in the second copying mode;

second memory means for storing the data which are related to the image density for copying said second portion of the original document in the second copying mode;

first entry means for enabling the first memory means to store the data which is input by said input means;

second entry means for enabling the second memory means to store the data which is input by said input means;

first controlling means for controlling said process means to copy the original document with the desired density based on the data which is stored by the first memory means and the second memory means in the second copying mode; and third entry means for enabling the first memory means to store the data which are input by said input means and as well as for enabling the second memory means to store the same data which are input by said input means.

7. A copying apparatus according to claim 6, wherein said third entry means is a print start key for starting the operation of said process means.

8. A copying apparatus according to claim 6, further comprising second control means for inhibiting the operation of said first entry means and said second entry means during the first copying mode.

9. A copying apparatus according to claim 6, wherein said process means includes lamp means for illuminating of the original document, and said first control means controls the quantity of light emitted by said lamp means by controlling power supplied to said lamp.

10. The apparatus of claim 1, wherein said original document is a book and wherein said first and second portions of said original document are successive pages of said book.

11. The apparatus of claim 1, wherein said first portion of said original document is a first sheet and wherein said second portion of said orginal document is a second sheet.

12. A copying apparatus comprising:

scanner means for scanning a first copying area and a second copying area;

process means for copying an image at said first copying area on a first recording medium surface and an image at said second copying area on a second recording medium surface;

input means for inputting first data relating to a copying condition for copying the image at said first copying area and for inputting second data relating to a copying condition for copying the image at said second copying area;

means for storing said first data in a first memory means and for storing said second data in a second memory means;

control means for controlling said process means to effect copying of the image at said first copying area based upon said first data and to effect copying of the image at said second copying area based upon said second data; and third entry means for storing said first data in said first memory means and for storing said first data in said second memory means as said second data.

13. A copying apparatus according to claim 12, wherein said first and second data are related to densities of images to be formed on the recording mediums.

14. A copying apparatus according to claim 13, wherein said process means includes lamp means for illuminating the original document, and said control means controls the quantity of light emitted by said lamp means by controlling the power supplied to said lamp.

15. A copying apparatus comprising:

scanner means for scanning a first copying area and a second copying area adjacent said first copying area;

processing means operative in a first mode for copying an image from said first copying area and a image from said second copying area on adjacent portions of a single surface of a recording medium, said processing means operative in a second mode for copying an image from said first copying area on a first recording medium surface and an image from said second copying area on a second recording medium surface;

selection means for selecting one of said first and second modes;

input means for inputting data relating to the density of the image to be formed on the recording medium to a desired value;

first memory means for storing the data which are related to the image density for copying said image from said first copying area in the second copying mode;

second memory means for storing the data which are related to the image density for copying said image from said second copying area in the second copying mode;

first entry means for enabling the first memory means to store the data which is input by said input means;

second entry means for enabling the second memory means to store the data which is input by said input means;

first controlling means for controlling said process means to copy the images from said first and second copying areas with the desired density based on the data which is stored by the first memory means and the second memory means in the second copying mode, respectively; and third entry means for enabling the first memory means to store the data which are input by said input means and for enabling the second memory means to store the same data which are input by said input means.

16. A copying apparatus according to claim 15, wherein said third entry means is a print start key for starting the operation of said process means.

17. A copying apparatus according to claim 15, further comprising second control means for inhibiting the operation of said first entry means and said second entry means during the first copying mode.

18. A copying apparatus according to claim 15, wherein said process means includes lamp means for illuminating the original document, and said first control means controls the quantity of light emitted by said lamp means by controlling power supplied to said lamp.

* * * * *